United States Patent [19]

Brown

[11] 4,107,822

[45] Aug. 22, 1978

[54] PROCESS FOR MAKING A BATT OF MODIFIED BASIS WEIGHT PROFILE AND LENGTHWISE UNIFORMITY

[76] Inventor: Roger Alan Brown, 2131 Elm Hill Pk. C-54, Nashville, Tenn. 37210

[21] Appl. No.: 804,854

[22] Filed: Jun. 8, 1977

[51] Int. Cl.[2] ..... D04H 1/00

[52] U.S. Cl. ..... 19/163; 5/337

[58] Field of Search ..... 19/163, 160, 156.3, 19/65 T, 66 T; 5/337

[56] References Cited

U.S. PATENT DOCUMENTS

| | | | |
|---|---|---|---|
| 2,387,150 | 10/1945 | Hlavaty | 19/163 |
| 3,753,263 | 8/1973 | Willis | 5/337 |
| 3,797,074 | 3/1974 | Zafiroglu | 19/156.3 |
| 3,903,568 | 9/1975 | Watson | 19/163 |

*Primary Examiner*—Dorsey Newton

[57] ABSTRACT

A batt is produced by cross lapping a web onto a conveyor moving laterally to the direction of web laydown to form partially overlapping folds. The length of the cross lapping motion is varied in a programmed cycle to produce a modified basis weight profile in cross sections of the batt. The conveyor speed is adjusted to provide a uniform basis weight profile along any section taken lengthwise of the batt. The process is useful for improving batt lengthwise uniformity while providing different basis weights at different distances from the sides of a batt.

1 Claim, 3 Drawing Figures

PROCESS FOR MAKING A BATT OF MODIFIED BASIS WEIGHT PROFILE AND LENGTHWISE UNIFORMITY

BACKGROUND OF THE INVENTION

This invention relates to a process for cross lapping a fibrous web to produce a batt composed of a plurality of web layers or folds. It is more particularly concerned with improvements in the cross-lapping operation to regulate the basis weight profile of batt cross sections and provide uniform basis weight profiles along any section taken lengthwise of the batt.

Webs of natural fibers or synthetic staple fibers are commonly produced by carding or air-laydown of the fibers. Heavier basis weight batts for cushioning purposes or thermal insulation, e.g., for use in pillows, quilts, garments, sleeping bags, cushions, mattresses or upholstered furniture, are commonly produced by cross-lapping webs to build up the required basis weight. Kalwaites U.S. Pat. No. 3,222,730 discloses carding fibers to form a web which is then deposited in a plurality of overlapping folds on a horizontal receiving conveyor by a "camel-back" cross lapper to form a batt. The cross lapper swings back and forth like a pendulum to guide the web downward onto the conveyor. The web is supported during its downward movement on an oscillating conveyor having a pile fabric surface to reduce slipping of the web. Laydown rolls lap the web onto the horizontal conveyor, which has a porous surface, and suction is applied through the conveyor to hold the laps in place.

Burger U.S. Pat. No. 3,682,734 discloses an improvement over the "camel-back" type of cross lapper apparatus for use in bias crosslaying fiber webs. Web laydown rolls are mounted in carriages arranged to reciprocate horizontally back and forth above a horizontal carrier sheet moving at right angles to the direction of carriage movement. Horizontal belts are mounted in the carriages to support the webs and guide them down around the laydown rolls. Two webs may be crosslaid simultaneously at a spacing which provides crosslayers in edge-to-edge relationship on the carrier sheet, and an additional web may be deposited on top in longitudinal relationship to the carrier sheet. The web composite may be bonded together to produce a laminated structure. In order to provide a composite web having uniform characteristics the edges of the composite web are trimmed off.

Zafiroglu U.S. Pat. No. 3,797,074 discloses an air-laydown process for making uniform webs for producing nonwoven fabrics. However, cross lapping these webs by previously known processes has not provided product uniformity. The improved cross lapping process of the present invention provides means for compensating for process deficiencies which cause nonuniform products. The process provides for modification of cross-sectional basis weight profiles without loss of uniformity along any section taken lengthwise of the batt. For example, a gradual increase in basis weight from the side portions of the batt to the central portion of the batt is readily accomplished. Such batts would be useful in pillows.

SUMMARY OF THE INVENTION

The present invention is an improvement in the process of cross lapping a fibrous web onto a horizontal conveyor surface moving laterally to the direction of web laydown to form a batt. In accordance with the invention, the web is cross lapped onto the batt conveyor surface from a horizontal laydown surface moving back and forth across the batt conveying surface, and the length of the cross-lapping movement is varied in a programmed cycle of operation to obtain a modified basis weight profile in cross sections of the batt produced. The speed of the batt conveyor surface is maintained at a value equal to the width of the web divided by the time required to complete one cycle of operation.

The invention is particularly useful for forming batts from webs produced by air-laydown of staple fibers, since such webs are fragile and easily distorted as initially formed by air-laydown. A web being produced as disclosed in U.S. Pat. No. 3,797,074 can be fed directly to the cross-lapper machine and formed into a batt with a minimum of handling. The web is preferably fed onto the horizontal laydown surface by a horizontal supporting surface which moves so as to provide a constant path length to the batt conveying surface during the cross-lapping operation.

In accordance with one embodiment of the invention, full laps alternating with different sizes of smaller laps are formed in a repeating cycle along the length of the batt being produced. This procedure is suitable for providing a gradual increase in basis weight from side portions of the batt to central portions of the batt. The cross-sectional basis weight profiles of the batt will be alike when the speed of the batt conveying surface is maintained as specified.

DETAILED DESCRIPTION OF THE INVENTION

Figure 1:
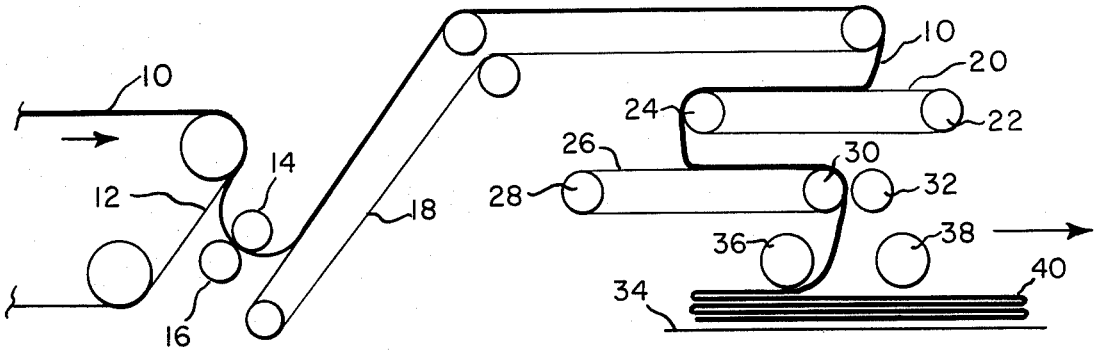
FIG. 1 is a schematic side view of a cross lapper machine for use in the process.

In FIG. 1 a web 10 is conveyed on belt 12, passes between rolls 14 and 16 for consolidating the web, and passes onto feeder belt 18 of the cross lapper machine. The web is fed onto horizontal supporting belt 20 moving around rolls 22 and 24 mounted on an upper carriage (not shown). The web passes onto a horizontal laydown belt 26 moving around rolls 28 and 30 mounted on a lower carriage (not shown). The web then passes between roll 30 and guide roll 32 and is deposited on floor conveyor apron 34 to form a batt. The carriages move back and forth across apron 34 to cross lap the web in overlapping folds. The supporting belt is used above the laydown belt to provide a constant path length from the feeder belt to the floor laydown apron. Rolls 36 and 38 press the folds into place on the apron. The apron conveys the batt 40 laterally to the direction of web laydown to form partially overlapping folds.

Figure 2:
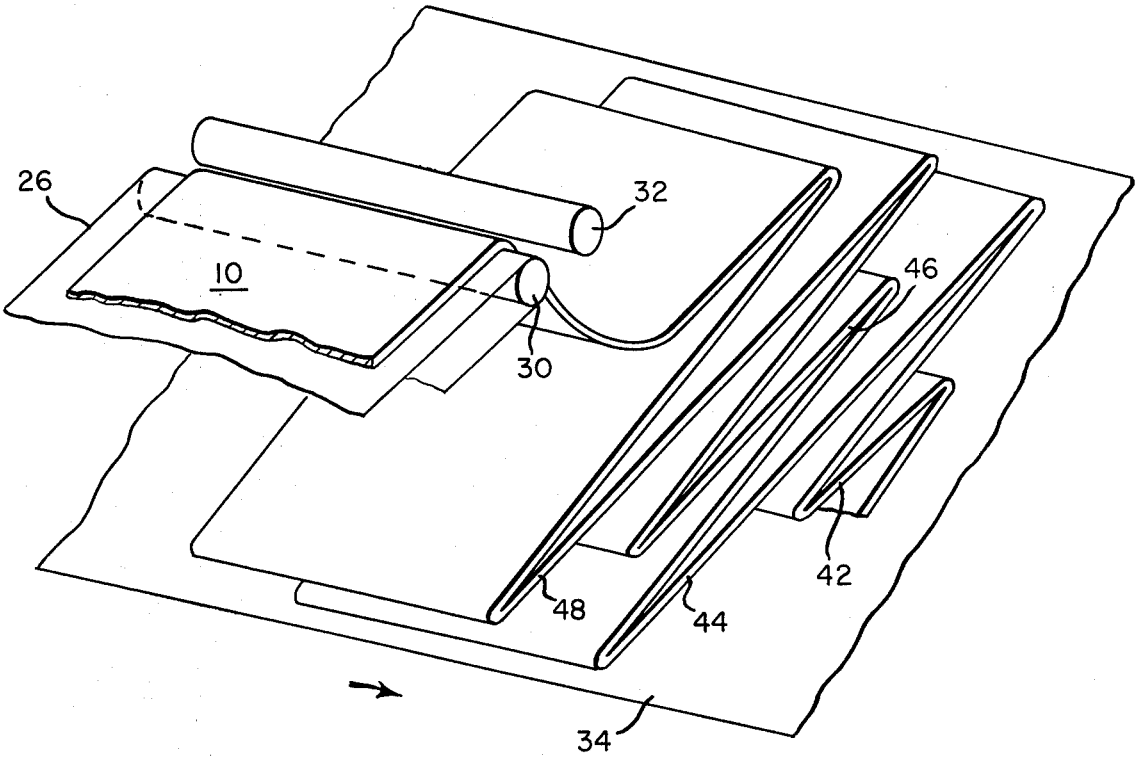
FIG. 2 is a schematic view of a web being cross lapped in folds of varying lengths.

FIG. 2 illustrates cross lapping the web in folds of varying lengths. For simplicity, only rolls 30 and 32 of the cross lapper and a portion of belt 26 are shown. The small lap 42 is formed by moving the roll 30 part way across floor conveyor apron 34, reversing the direction of movement for a short distance and then resuming the original direction of movement to the far side of the batt being formed; the roll 30 is then returned to the near side of the batt to form a full lap 44. This operation is repeated to form a somewhat larger lap 46 and a full lap 48. Meanwhile, apron 34 conveys the laps away from the cross lapper so that the laps partially overlap like shingles.

Figure 3:
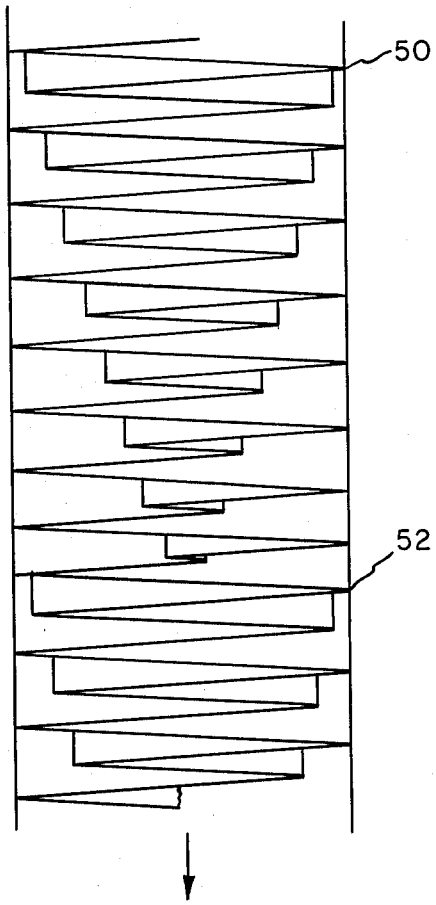
FIG. 3 is a schematic top view of one form of batt produced by the process of this invention.

FIG. 3 illustrates a batt formed by the above procedure. The batt has full laps alternating with eight different sizes of smaller laps. These laps are formed in a repeating cycle along the length of the batt. During formation of the batt, the time required to complete each cycle of sixteen laps and the speed of the conveyor apron have been adjusted so that the width of the web being cross lapped is equal to the distance required to complete a cycle, e.g., the distance from point 50 to point 52. A batt produced in this manner will have a uniform basis weight profile along any section taken lengthwise of the batt. In other words all of the cross-sectional profiles will be alike, even though the basis weight may increase and/or decreases between opposite sides of the batt. For the embodiment shown, the basis weight increases gradually from each side portion of the batt to a maximum in the central portion where the shortest lap is located. Each cross section will cut through all of the differently sized laps, although the lap sequence of 1 through 16 at one cross section, may be 5–16, 1–4 at another cross section, and 10–16, 1–9 at a third cross section.

During operation of the cross lapper, the speeds of the web supporting belts and the cross-lapping motion should be accurately controlled to avoid uneven tension on the web which could cause nonuniformities in the web and in the batt produced. The lap laydown should be accurately controlled to minimize the necessity of trimming irregularities from the sides of the batt, and to provide the desired cross-sectional profile. The extent of cross-lapping movement can be electrically controlled by conventional means adapted to be preset for full laps and shorter laps in a programmed cycle.

The crosslapper is moved back and forth by drive means acting through air-actuated clutches. The position of the lower carriage is continuously monitored by a rotary, variable, differential transformer (RVDT). The RVDT sends a voltage proportional to the carriage position to control means for actuating the air clutches. The control means compares the RVDT signal with a preset reference voltage corresponding to a desired carriage reversal position. When the RVDT voltage is equal to the preset voltage the control means actuates an air clutch which reverses the direction of carriage travel. After each reversal the control means automatically advances to the next preset voltage for comparison with the next RVDT signal. After the control means has advanced through all of the preset voltages of one complete cycle, the cycle is repeated. Since the speed of the batt conveyor apron is maintained at a value equal to the width of the web being lapped divided by the time required to complete one cycle of operation, the number of preset voltages in one cycle will determine the batt thickness at a lengthwise section passing through all of the laps deposited in one cycle.

EXAMPLE

A batt 160 inches wide is produced by cross lapping a web as illustrated in FIG. 1. A web of polyester staple fibers, 160 inches wide having a basis weight of 3.4 ounces per square yard, is supplied continuously from an air-laydown machine of the type disclosed in U.S. Pat. No. 3,797,074. The control means described is preset to reverse the direction of carriage travel at the locations indicated in the table below for one cycle of operation. The time for one cycle is 3.55 minutes. The speed of the batt conveyor apron is 45 inches per minute. The batt produced has cross-sectional profiles which have a thickness of 28 webs in the central portions and taper to a lesser thickness adjacent to the sides of the batt. The batt has a uniform basis weight profile along any section taken lengthwise of the batt.

| Carriage Reversal Locations For One Cycle Of Operation Inches From Side of Batt | |
|---|---|
| Left | Right |
| 0 | 0 |
| 20 | 30 |
| 0 | 0 |
| 0 | 1 |
| 0 | 0 |
| 24 | 8 |
| 0 | 0 |
| 0 | 36 |
| 0 | 0 |
| 0 | 3 |
| 0 | 0 |
| 29 | 0 |
| 0 | 0 |
| 0 | 0 |

I claim:

1. In the process of cross lapping a fibrous web onto a horizontal conveyor surface moving laterally to the direction of web laydown to form a batt, the improvement which comprises cross lapping the web onto the batt conveyor surface from a horizontal laydown surface moving back and forth across the batt conveying surface, varying the length of the cross-lapping movement in a programed cycle of operation to obtain a modified basis weight profile in cross sections of the batt produced by varying the length of the cross-lapping movement to form full laps alternating with different sizes of smaller laps in a repeating cycle along the length of the batt, wherein the sizes of the smaller laps are varied to provide a gradual increase in basis weight from side portions of the batt to central portions of the batt, and maintaining the batt conveyor speed at a value equal to the width of the web divided by the time required to complete one cycle of operation.

* * * * *